United States Patent [19]

Brown et al.

[11] 4,000,770

[45] Jan. 4, 1977

[54] APPARATUS AND METHOD FOR MANUFACTURING CORES AND MOLDS

[75] Inventors: Lloyd H. Brown, Crystal Lake; Daniel S. P. Eftax, Barrington; Joseph N. Kopp, Chicago, all of Ill.

[73] Assignee: The Quaker Oats Company, Chicago, Ill.

[22] Filed: Apr. 21, 1975

[21] Appl. No.: 569,827

[52] U.S. Cl. ..... 164/21; 164/200

[51] Int. Cl.[2] ..... B22C 15/24

[58] Field of Search ..... 164/21, 43, 165, 166, 164/200, 201, 202; 250/4 R, 18, , 36, 4 AB, 4 AC; 425/DIG. 49; 222/193

[56] References Cited

UNITED STATES PATENTS

| | | | |
|---|---|---|---|
| 2,929,248 | 3/1960 | Sprenkle | 259/4 AC X |
| 3,179,134 | 4/1965 | Sigrist | 222/193 X |
| 3,366,277 | 1/1968 | Barber | 222/193 X |
| 3,439,733 | 4/1969 | Miller et al. | 164/200 |
| 3,472,307 | 10/1969 | Godding | 164/43 X |
| 3,494,412 | 2/1970 | Abraham | 164/200 X |
| 3,580,326 | 5/1971 | Edwards | 164/200 |
| 3,590,906 | 7/1971 | Bayliss et al. | 164/43 X |
| 3,643,927 | 2/1972 | Crouch | 259/4 AB |
| 3,800,985 | 4/1974 | Grout et al. | 425/DIG. 49 X |

*Primary Examiner*—Ronald J. Shore
*Attorney, Agent, or Firm*—Eugene M. Cummings; Joseph P. O'Halloran

[57] ABSTRACT

An apparatus and method for forming foundry cores and molds of superior hardness and uniformity in a wide range of sizes includes staging hoppers for storing a first mass of sand coated with a catalyst-polymerizable resin film, and a second mass of sand coated with a catalyst film for polymerizing the resin. In forming the cores or molds these masses are simultaneoulsy and evenly dispersed into a high velocity carrier air-sand stream and directed through a static mixer, wherein the resin and catalyst-coated sand particles are intermingled and at least a partial integration of the films takes place, into a shaping mold cavity, wherein the sand mixture hardens into a desired shape. Because the process is fast and continuous, and allows the use of resin-catalyst systems having very fast hardening times, the apparatus and method are particularly well suited to high volume foundry operations wherein it is desirable to reduce the residence time required in the shaping molds to minimize the number of molds and the storage space required.

18 Claims, 18 Drawing Figures

FIG. 1
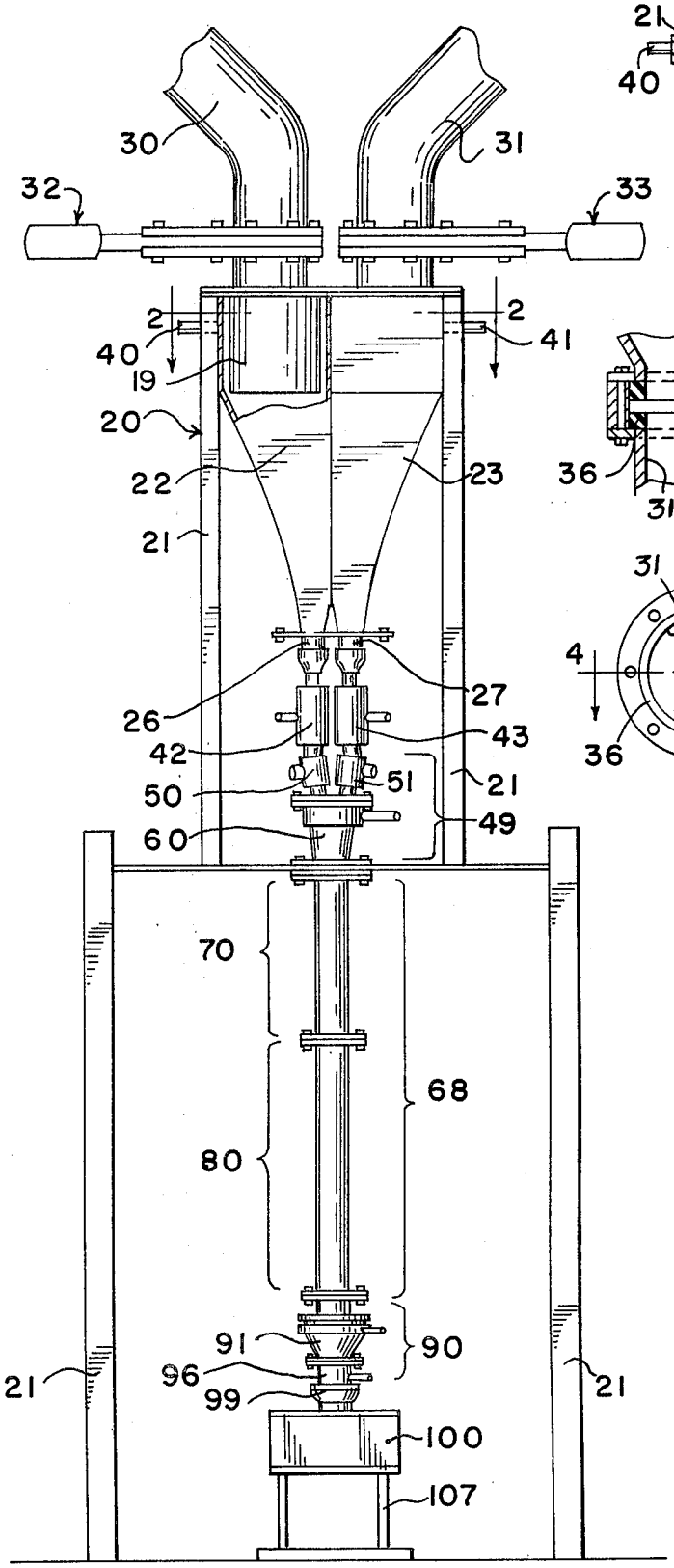
FIG. 2
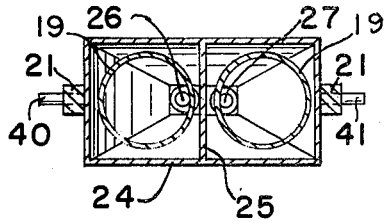
FIG. 4
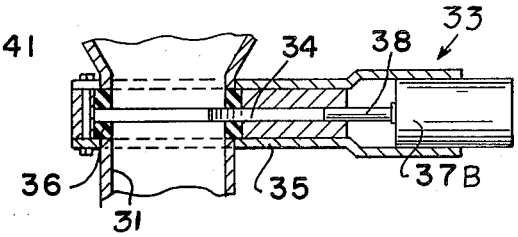
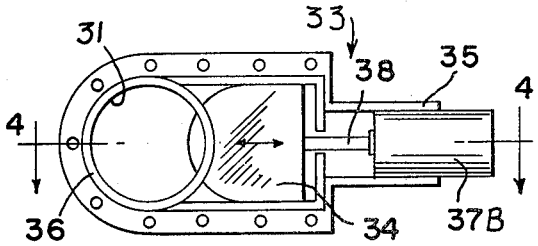
FIG. 3
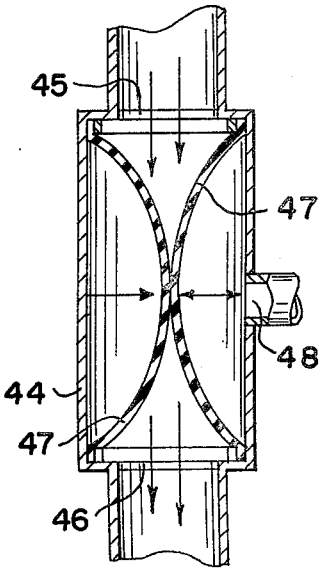
FIG. 5

73
75
74
70
72
71
74
68
83a
81
82
φ
80
84
85
87
83b
86
83c
81
83
81
83
81
83
83a
82
81
83b
83c
83a
82
81
83b
83c

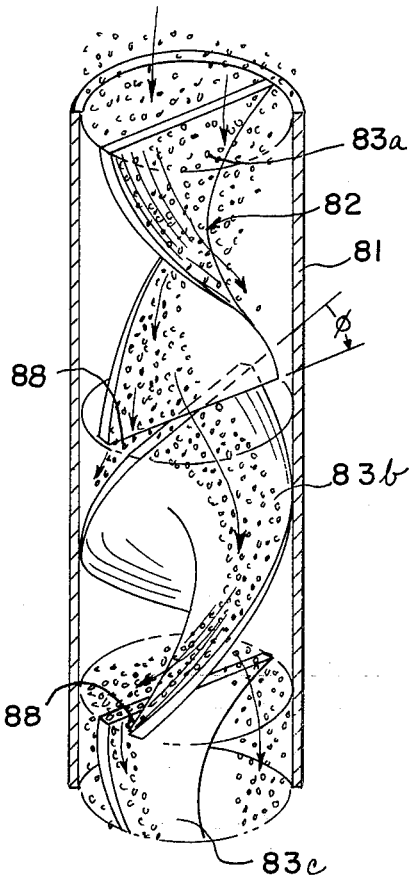
FIG. 13
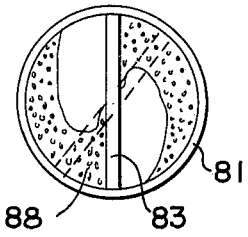
FIG. 14
FIG. 15
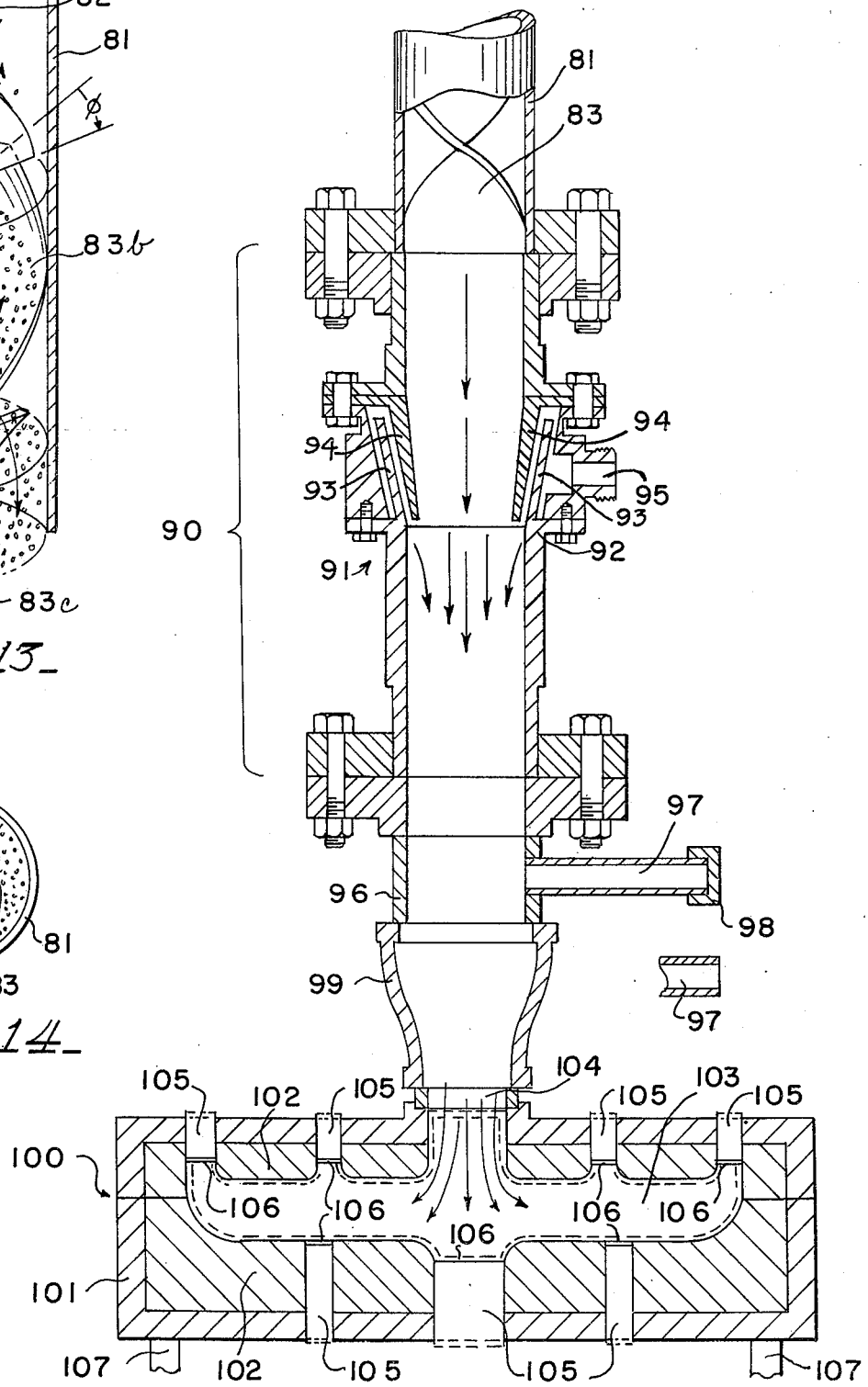

SURGE TANK
112
118
117
116
114
115
124
122
123
120
121
129
128
127
125
126
30
31
134
133
132
130
32
33
37b
131
37a
40
41
139
137
138
135
136
22
23
144
142
143
140
42
43
141
50
51
111
60
149
147
148
145
146
70
154
152
153
150
68
151
21
80
159
157
158
155
90
91
107
100
110
PUMP
113
156

APPARATUS AND METHOD FOR MANUFACTURING CORES AND MOLDS

BACKGROUND OF THE INVENTION

The present invention relates to the manufacture of foundry cores or molds, and more particularly to a method and apparatus for manufacturing foundry cores or molds by the integration of a mess of particles, such as sand, into hardened accurately dimensioned forms by means of a catalyst-resin system distributed on the respective particles in the mass.

In recent years the cold-curing process of making foundry cores has come into wide use foundry operations. Basically, this process involves mixing separately two volumes of sand or other particulate matter, one with a liquid catalyst-polymerizable resin or binder, such as a Furfuryl alcohol-derived binder, and the other with a liquid catalyst, such as a mixture of phosphoric and sulfuric acids, until each particle is coated with a film of the resin or catalyst. These two separate sand mixtures are thoroughly mixed or integrated together and deposited in a core box or mold, wherein the catalyzed hardening reaction initiated by the combining of the resin with the catalyst continues until the combined sand mixture hardens into a shaped, substantially integral mass suitable for use as a core or mold in subsequent foundry casting operations.

Unfortunately, this otherwise highly useful method of forming foundry cores or molds suffers several inherent shortcomings. Since the hardening of the catalyst-binder film commences instantly as the separate binder and catalyst-coated sand mixtures are combined, the curing or hardening of the combined sand mixture undergoes at least some progress during the time required to complete the combining operation and before the catalyzed-resin sand mixture is actually forced or placed into the core mold. It is recognized that the greater the extent of the advancement of the hardening of the catalyzed-resin sand mixture prior to its coming to rest in the core box, the weaker will be the resulting core or mold. Furthermore, such advanced hardening may interfere with the proper functioning of the mixing apparatus utilized to combine the two sand mixes, resulting in incomplete mixing and consequent soft spots or voids in the complete mold, or in undesirable jamming or blockage of the mixing apparatus.

Adoption of less reactive resin-catalyst mixes is not a completely satisfactory solution since the longer period of time required of such mixes to set or harden necessitates a longer residence time in the core box, necessitating a greater number of core boxes and a larger storage capability. In high volume production operations, particularly those involving the manufacture of large or complex cores or molds, such requirements often cannot be met without destroying the economic viability of the core or mold forming operation. A more satisfactory solution is to shorten the transmit time in the mixing apparatus so that a minumum of hardening of the combined sand mix takes place prior to the combined sand mixture being forced into the core box. Unfortunately, previous attempts at reducing transit time have not been entirely satisfactory, since they have failed, particularly when producing larger sized cores, e.g. above 100 pounds, to achieve the thoroughness of mixing of the resin and catalyst sand mixes necessary to consistently obtain cores or molds of uniform hardness and dimensional accuracy. Furthermore, the apparatus for such prior art attempts have not been readily adaptable to forming cores in a wide range of a sizes, preventing the use of one machine for forming both large and small cores, e.g. cores from five pounds to five hundred pounds. The present application is directed to apparatus for forming foundry cores or molds which continuously and thoroughly combines the resin and catalyst sand mixes while requiring minimum transit time to economically produce cores or molds having a wide range of sizes.

Accordingly, it is a general object of the present invention to provide a new and improved apparatus for forming foundry cores.

It is another object of the present invention to provide a new and improved apparatus for forming foundry cores at high production rates which provides cores of uniform and consistent hardness and dimensional accuracy.

It is a further object of the present invention to provide a new and improved method for manufacturing foundry cores of improved consistency and hardness.

It is a further object of the present invention to provide a new and improved apparatus and method for manufacturing foundry cores by means of the cold-curing process whereby the resin and catalyst sand mixtures are combined with improved thoroughness and reduced transit time to obtain cores having improved hardness and consistency.

It is a further object of the present invention to provide apparatus for making foundry cores or molds in a wide range of sizes, e.g. of 5 pounds to 500 pounds or more, with slow, fast, or very fast hardening binder-catalyst systems.

It is a further object of the present invention to provide apparatus and a method with which, even in the production of large cores and molds, e.g. cores and molds about 25 pounds, and especially about one hundred pounds, a highly reactive sand-binder-catalyst system or a highly reactive sand system having substantially zero bench life can be used, and in which each increment of the highly reactive sand mix is virtually instantaneously placed in the desired position in the core box or mold pattern.

It is a further object of the present invention to provide apparatus for making foundry cores or molds and a method in which highly reactive catalyzed mix of particulate material, such as sand, can be continuously prepared and virtually instantly deposited in a shaping element such as a core box or mold pattern, with such speed that the binder-hardening reaction has undergone little, if any, advancement prior to the placement of each respective increment of the particulate material in its ultimate situs in the shaping element.

It is a further object of the present invention to provide apparatus and a method with which respective particles of a reactive catalyzed sand-binder mixture are maintained in highly disbursed but thoroughly intermingled condition until the particles are deposited at their ultimate situs in a mass shaping element, at which situs the particles are packed in an intermingled condition in direct contact with each other to form a shaped mass capable of hardening and becoming self-supporting in a very short period of time.

SUMMARY OF THE INVENTION

The invention is directed to apparatus for forming a hardened core or mold from a first mass of particulate matter coated with a catalyst-polymerizable resin film and a second mass of particulate matter coated with a catalyst film for polymerizing the resin. The apparatus comprises means including a first staging hopper for storing a quantity of the first mass of particulate matter, means including a second staging hopper for storing a quantity of the second mass of particulate matter, a core box having an interior void defining the desired core or mold, static mixer means including a conduit for establishing a flow path for the particulate masses the first and second staging hoppers into the core box, the static mixer means including a mixing section for mixing the masses as they pass through the conduit, and primary air injection means for establishing a continuous stream-like flow of the particles along the flow path whereby the first and second masses are thoroughly and rapidly intermingled and the films are at least partially integrated to form a catalyzed polymerizable resin-coated particulate mix for deposite in the core box.

The invention is further directed to a method of blending respective ingredient sands having respective liquid films dispersed on the surface thereof, and of substantially mixing and integrating the films, comprising the steps of simultaneously introducing the sand ingredients into a moving carrier air stream thereby forming an air-sand stream, channelling the air-sand stream through static mixer means for intermingling the ingredient sands and for substantially integrating the films therein, and thence by means of the air-sand stream transporting and depositing the resulting mixture into a shaping cavity.

BRIEF DESCRIPTION OF THE DRAWINGS

The features of the present invention, which are believed to be novel, are set forth with particularity in the appended claims. The invention, together with the further objects and advantages thereof, may best be understood by reference to the following description taken in connection with the accompanying drawings, in the several figures of which like reference numerals identify like elements, and in which:

FIG. 1 is a front elevational view of a core or mold making apparatus constructed in accordance with the invention.

FIG. 2 is a cross-sectional view of the staging hoppers taken along line 2—2 of FIG. 1.

FIG. 3 is a top plan view, partially in cross-section, of the blade-type hopper infeed valves utilized to control the filling of the stating hoppers of the core making apparatus of FIG. 1.

FIG.4 is a cross-sectional view of the hopper infeed valves taken along the 4—4 of FIG. 3.

FIG. 5 is a side elevational view, partially in cross section, of the diaphragm-type sand-mix outfeed control valves utilized in the core making apparatus of FIG. 1.

FIG. 13 is a perspective view of a portion of the mixing section broken away to illustrate the flow of sand particles over the interior vanes when the vanes are orientated at a less than optimum angle.

FIG. 14 is a cross-sectional view of the mixing section of FIG. 13 illustrating the flow of the air-sand stream therein.

FIG. 15 is a side elevational view, partially in cross section, of the secondary air injection stage of the core-making apparatus showing a core box in position for receiving the catalyzed-resin coated sand mix.

DESCRIPTION OF THE PREFERRED EMBODIMENT

Figure 6:
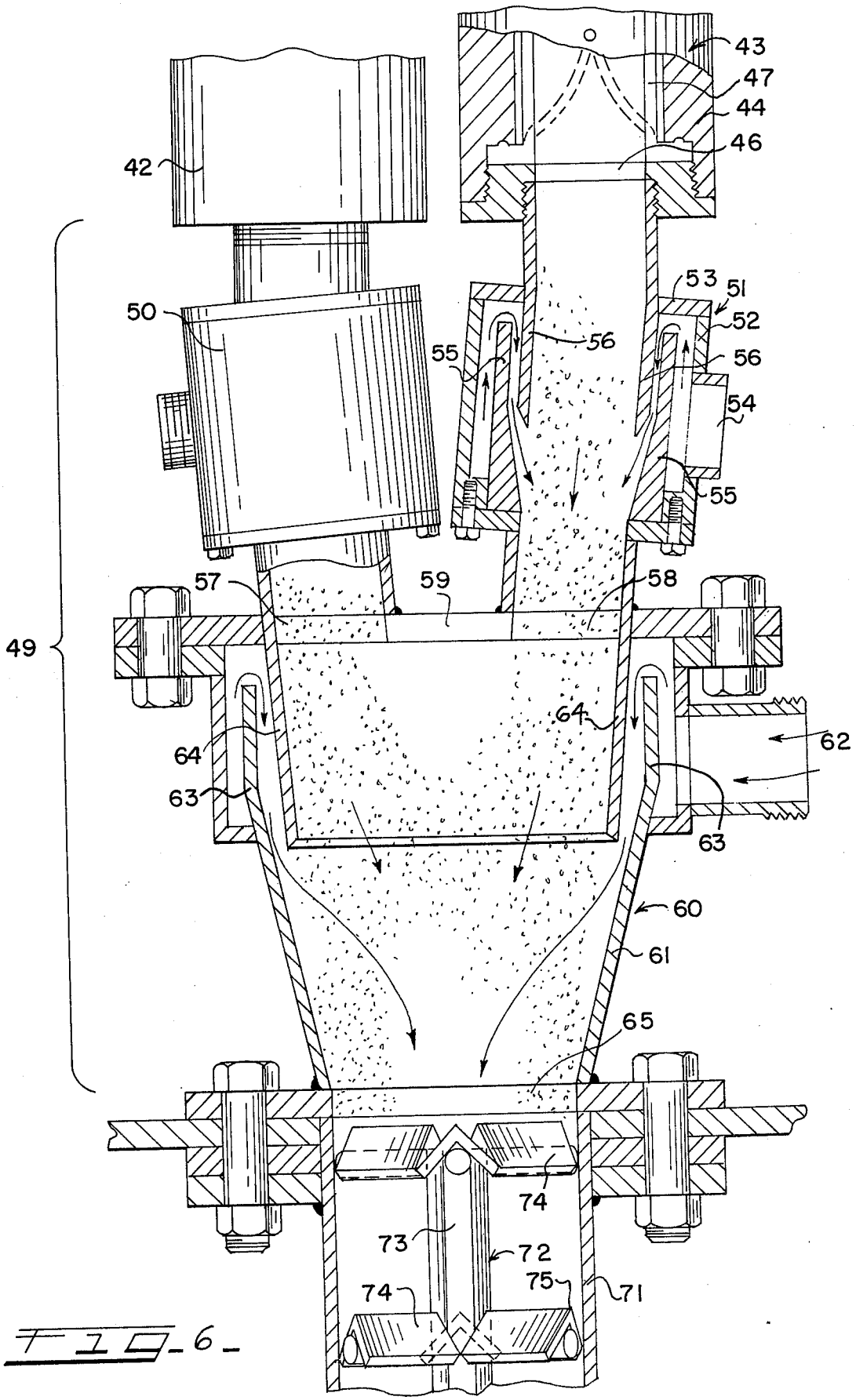
FIG. 6 is an enlarged side elevational view, partially in cross section and partially broken away, showing the primary air injection stage of the core making apparatus of FIG. 1.

Referring to the figures, and particularly to FIGS. 1 and 2, a core-making apparatus 20 incorporating the features of the present invention includes an upright frame 21 on which a first staging hopper 22 for containing a quantity of a resin-coated particulate substance, such as sand, and a second staging hopper 23 for containing a quantity of a catalyst-coated particulate substance, which may also be sand, are mounted. While these staging hoppers may be of any convenient size and shape, it is preferred that they be configured to discharge their contents along relatively parallel and closely spaced directions. To this end, the staging hoppers are formed with an outside wall 24 of generally rectangular cross-section and a common inside wall 25 arranged to form two interior volumes of generally square cross-section, as shown in FIG. 2. Near the top of the hoppers the sides of wall 24 are generally vertical to form infeed portions of generally constant cross-section within the hoppers. Below these portions the sides of wall 24 curve inwardly in generally parabolic form to communicate with separate but closely spaced discharged ports 26 and 27 from which the contents of the hoppers can be withdrawn.

Loading of staging hoppers 22 and 23 is accomplished by means of respective ones of two infeed conduits 30 and 31, which may rely on the force of gravity, or on powered means such as conveyors or transfer screws (not shown) to transfer a particulate mass into the hoppers. Infeed hoppers 30 and 31 communicate with respective ones of two cylindrical baffles 19 which extend into the infeed portions of the hoppers. As will be explained presently, the purpose of these baffles is to form an annular air chamber within the hoppers which enables the hoppers to be pressurized in a manner which will prevent uneven erratic discharge of the contents of the hoppers.

As mentioned previously, to practice the cold-curing process of forming foundry molds or cores it is necessary to have a quantity of sand (or other particulate matter) thoroughly coated with a film or resin, and another quantity of sand thoroughly coated with a film of a suitable catalyst. To this end, the respective sand mixes prior to being loaded into staging hoppers 22 and 23 are thoroughly mixed by appropriate means such as conventional muller machines to obtain a thorough and uniform coating of each sand particle with either the resin or catalyst. Ordinarily, the quantity of resin and catalyst thus applied to the respective sand masses is twice that actually required for optimum catalyzed bonding, since the effective concentration of the resin and catalyst will be halved when the two masses are subsequently combined to initiate the hardening reaction.

Staging hoppers 22 and 23 are normally maintained filled with resin and catalyst sand mixtures automatically so that at any given time there will be sufficient sand mix available in each hopper to satisfy at least the requirements of the next mold or core-forming cycle of the core-making apparatus. The infeed of the sand mixes into the hoppers is controlled by means of respective ones of two pneumatically-operated slide-type blade valves 32 and 33 which close to pneumatically seal the hoppers from conduits 30 and 31 at the beginning of each core-forming cycle. Referring to FIGS. 3 and 4, blade valve 33, which may be conventional in design and construction, includes a blade 34 slidably mounted for reciprocation in a housing 35 between a closed position wherein it blocks the conduits and an open position wherein the sand mix can freely pass through the conduits. In its closed position, blade 34 extends across the entire cross-section of conduit 31 and seats in a gasket 36, which assists in maintaining the desired pneumatic seal. Actuator means in the form of a pneumatic cylinder **37*b* serves to actuate actuator rod 38 connected to blade 34 to position the blade as required during each operating cycle. Blade valve 32 may be identical in design and construction to blade valve 33, except that it incorporates a pneumatic cylinder 37*a*to position its blade with respect to conduit 30**. Although blade-type valves, because of their large aperture and ability to rapidly close on a packed and static column of sand, are preferred for the infeed control application, it will be appreciated that other types of valves could be used instead.

To prevent the sand mixes from backing up into the hoppers and to provide the driving force required to discharge the sand mixes, staging hoppers 22 and 23 are pressurized during a portion of the core-forming cycle. This is accomplished by means of inlet ports 40 and 41 (FIGS. 1 and 2), which extend through the outside wall 24 of the staging hoppers to establish communication with the infeed portions of repsective ones of the hoppers. Pressurized air, typically in the order of 8–13 psi, is applied to these conduits to establish a like pressure within the hoppers.

The two cylindrical baffles 19 cause annular voids about their outside surfaces to be formed where sand mix is not supplied by conduits 30 and 31. By introducing the pressurized air into these voids instead of into the central sand-mix-filled portions of the hoppers, so-called ratholing or uneven feeding along the core of the sand mix mass is avoided. This feature is described and claimed in the co-pending application of Kopp et al. Ser. No. 569,826, filed Apr. 21, 1975 and assigned to the present assignee.

To control the discharge of the resin and catalyst sand mixes from the hoppers, the discharge ports 26 and 27 of the hoppers are connected to respective ones of two pneumatically-operated diaphragm-type sand mix outfeed control valves 42 and 43, which may be conventional in design and construction. Referring to FIG. 5, each of these valves comprises an elongated cylindrical housing 44 having a receiving port 45 at one end and a discharge port 46 at its other end. The inside surface of housing 44 is fitted with an annular sleeve 47 formed of a flexible material such as rubber. The margins of the two ends of sleeve 47 are sealingly engaged to the inside surface of housing 44 adjacent the receiving and discharge ports 45 and 46 so that the sleeve normally lies flat against the inside surface of the cylindrical valve housing, allowing air and particulate substances such as sand to freely pass through. To shut off flow through the valve, the sleeve 47 is made to bulge inwardly away from the inside surface of housing 44 toward the center of the valve passageway by supplying pressure to a control port 48 provided in the wall of the valve housing. Since the liner is annular in shape and the margins of the ends of the liner are sealed to the valve housing, expansion resulting from pressure applied through control port 48 takes place around the entire inside periphery of the housing. As a result, the flow path through the valve is progressively and quickly restricted from all sides until flow is entirely cut off, as shown in FIG. 5.

This type of valve, because of its ability to rapidly and completely change from an unrestricted flow condition to a completely cut off flow condition, is particularly well adapted for controlling the overflow of sand from staging hoppers 22 and 23. The use of this valve allows the timing of the flow from hoppers 22 and 23 to be precisely controlled to insure accurate and complete mixing of equal volumes of the resin and catalyst sand mixes. Furthermore, a diaphragm-type valve such as that illustrated in FIG. 5 has the advantage of good abrasion and good chemical resistance to the silica sand typically used for making cores and molds.

Once passed by outfeed control valves 42 and 43, the resin and catalyst sand mixes enter a primary air injection and combining stage 49 (FIG. 6), wherein the mixes pass through respective ones of two in-line air injection or booster fittings 50 and 51 which introduce air under pressure into the flow paths. This air has sufficient velocity to maintain the sand in suspension, so that the two sand mixes form into rapidly flowing air-sand streams in which the pressurized air serves as a carrier medium.

As shown in FIG. 6, the two in-line air injection fittings 50 and 51 each consist of a cylindrical housing 52 and an end cap 53. The end caps include an inlet port for receiving the air-sand streams from respective ones of the sand injection control valves 42 and 43. A pressure inlet port 54 is provided in the side wall of the housing to receive pressurized air. This pressurized air is directed by means of a pair of concentric sleeve-shaped baffles 55 and 56 so as to circumferentially and coincidentally enter the flow paths of the resin and catalyst-coated sand mixes.

Infeed valves 32 and 33 are normally closed and staging hoppers 22 and 23 are normally pressurized during operation of the air injection fittings to force the sand mixes from the staging hoppers. The sand is directed downwardly through connecting conduits to respective inlet ports 57 and 58 on the end cap 59 of an optional third air injection fitting 60, which may be included in the primary air injection and combining stage 49. As shown in FIG. 6, this fitting includes a housing 61 having an air inlet port 62, a pair of concentric sleeve-like air distribution baffles 63 and 64, and a discharge port 65. As with air injection fittings 50 and 51, air is directed from inlet port 62 into coincident flow with the resin and catalyst coated sand streams. The two sand streams combine in air injection fitting 60, and if pressurized air is introduced in this fitting the velocity of the combined stream is further increased.

At this point the air-carried combined air-sand stream, which now includes both the resin sand mix and the catalyst and mix, enters a static mixer stage 68 (FIG. 7), the purpose of which is thoroughly intermingle the particles in the respective air-sand streams to obtain a substantial integration of the liquid resin and catalyst films on the particles prior to their being deposited in a core-forming mold. This stage is described and claimed in the co-pending application of Kopp et al. Ser. No. 569,824, filed Apr. 21, 1975 and assigned to the present assignee.

Figures 7, 8, 9, 10, 11, 12:
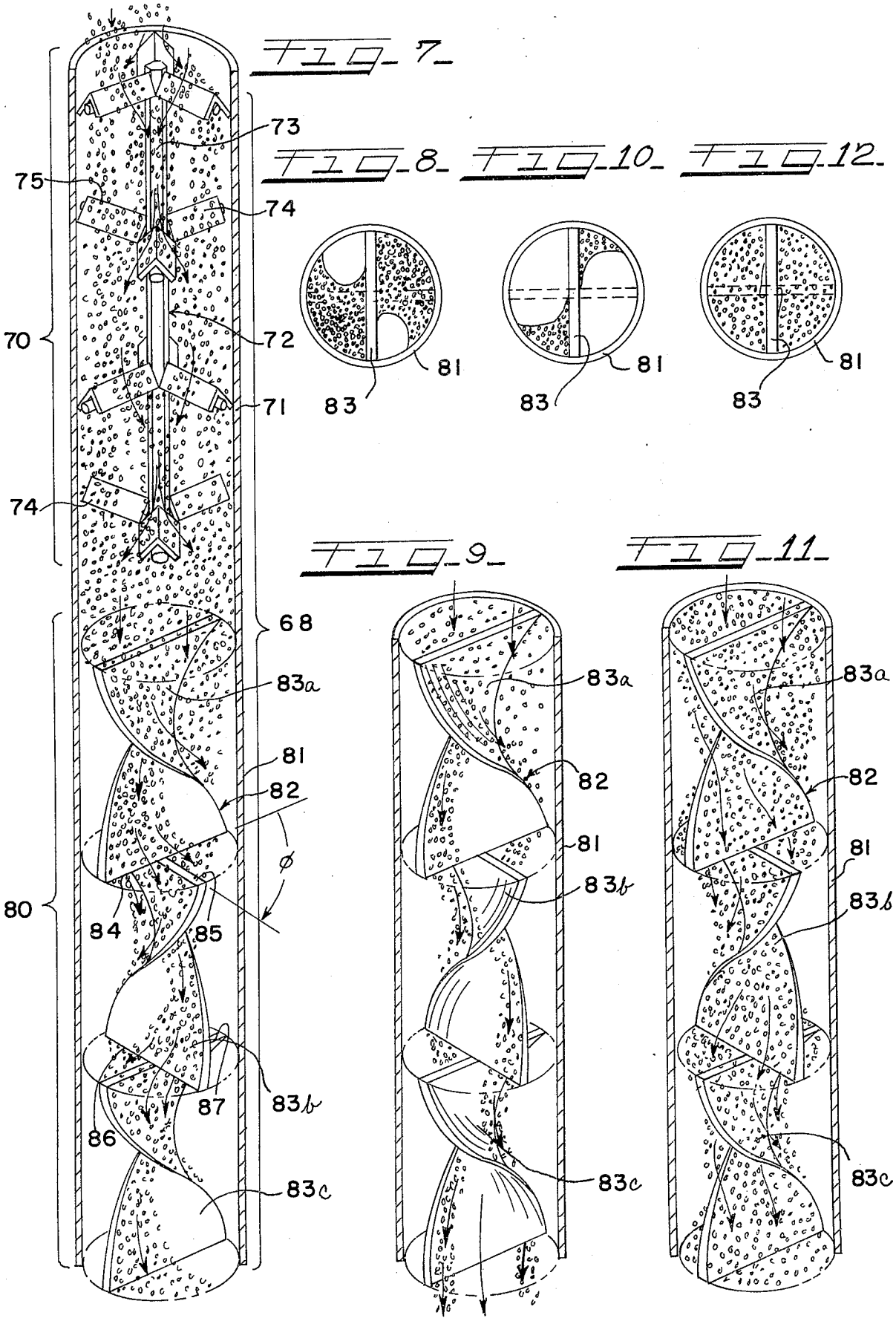
FIG. 7 is a perspective view of a portion of the static mixer stage of the core forming apparatus broken away to show the flow deflection vanes of the buffer and mixing sections of the stage and the effect of these vanes on the flow of the air-sand stream.
FIG. 8 is a cross-sectional view of the mixing section of FIG. 7 illustrating the flow of the air-sand stream therein.
FIG. 9 is a perspective view of a portion of the mixing section broken away to illustrate the flow of sand particles over the interior vanes at a lower than essential rate.
FIG. 10 is a cross-sectional view of the mixing section of FIG. 9 illustrating the flow of the air-sand stream therein.
FIG. 11 is a perspective view of a portion of the mixing section broken away to illustrate the flow of sand particles over the interior vanes at a greater than essential rate.
FIG. 12 is a cross-sectional view of the mixing section of FIG. 11 illustrating the flow of the air-sand stream therein.

Referring to FIG. 7, static mixer stage 68 is preferably composed of two sections; a buffer section 70 for buffering out or eliminating surging or other flow variations in the air-sand stream, and a mixing section 80 for intermingling the air-carried sand particles from buffer section 70 to achieve the desired film integration. The buffer section 70 includes a vertical conduit section 71 attached by means of a suitable bolt and flange arrangement to the discharge port 65 of air injection fitting 60. An internal tree-like vane assembly 72 within this conduit successively divides the sand stream from air injection fitting 60 to obtain uniform cross-sectional flow and to eliminate or reduce surging or uneven flow of the combined sand mix within the conduit. As shown in FIGS. 6 and 7, the vane assembly 72 includes a central support member 73 and a plurality of radially-extending wedge-shaped vanes 74 arranged in stacked Y-shaped tiers on member 73 so as to each present an upwardly facing edge 75 to divide the sand stream as it progresses along conduit section 71.

In operation, the air-sand stream from port 65, which may be non-uniform as illustrated in FIG. 7, is repeatedly divided as it flows downwardly over the leading exges 75 of vanes 74. As a result of this repeated division, flow irregularities are evened out and the combined air-sand stream is essentially uniform throughout conduit 71 as it enters mixing section 80. To obtain the necessary repeated flow divisions alternate tiers of vanes 74 are set at an angle on support member 73 with respect to the next preceding and next following tiers of vanes. Although only four tiers of vanes 74 are shown in buffer stage 70, it will be appreciated that in practice a larger number would ordinarily be employed. Furthermore, while only flow-dividing vane assembly 72 is shown, several such assemblies could be used, in a single conduit section 71, or in multiple conduit sections.

As the air-sand stream leaves buffer section 70 it enters mixing section 80 wherein a thorough mixing or intermingling of the resin-coated and catalyst-coated sand particles is carried out. As shown in FIG. 7, the mixing section 80 of the static mixer stage 68 includes a vertical conduit section 81 which has the same diameter as conduit section 71 to which it is joined. To achieve the desired mixing of the sand particles as they are carried through conduit section 81 a vane assembly 82 consisting of a plurality of auger-shaped helical flow divider vanes 83 joined end-to-end, one above the other, is positioned within the conduit section. Each of these helical vanes may be described as consisting of a plate extending diametrically across conduit section 81 which progressively twists through an angle of 180°. In the three-vane assembly 82 shown in FIG. 7, the trailing edge 84 of the first helical vane **83*a* is joined perpendicularly, i.e., at an angle $\phi$ of 90°, to the leading edge 85 to the second helical vane 83*b*. Similarly, the trailing edge 86 of the second helical vane 83*b* is joined perpendicularly to the leading edge 87 of the third helical vane 83*c*. It will be appreciated that although only three vanes 83*a*-83*c* have been shown in FIG. 7, additional vanes would ordinarily be provided within the mixing section 81** to obtain a more thorough intermingling between the resin-coated and catalyst-coated sand particles.

As the resin and catalyst-coated sand particles stream down conduit section 81 under the influence of the air pressure introduced by air injection fittings 50, 51 and 60, a very thorough mixing or intermingling of the sand particles is accomplished by the helical vane assembly 82. One reason for this thorough intermingling is the repeated division of the advancing air-sand stream into separate flow paths or channels by the leading edges of the vanes. Another reason is that the air-sand streams are caused to rotate by the helical pitch of vanes 83 as they proceed through conduit section 81, and the opposite pitch of rotation of successive helical vanes causes the streams of resin and catalyst-coated sand to reverse direction at each vane junction. Moreover, the sand particles in the air-sand streams are also caused to migrate radially in a programmed manner from the walls on conduit section 81 to the center of the stream and back. This movement, in addition to the back mixing which results from the constant change in flow profile of the air-sand streams as they pass through the changing geometric cross section of the flow paths defined by the helical vanes, further enhances the performance of mixing section 80.

The thoroughness of the mixing or intermingling action is also dependent on the rate of flow of the sand mixes through conduit section 81. It has been found that for useful mixing action the flow rate must be such that the flow channels formed on either side of the helical vanes 83 are between 50% and 90% full, as shown in FIG. 8. This results in a division of the air-sand streams in two flow channels as they come into contact with the leading edges of the next succeeding vane, everything over approximately half of the volume of each channel being caused to spill over into the alternate channel upon meeting the leading edge of the next succeeding vane. In contrast, when the flow rate is relatively small, i.e., less than 50% of the volume of the channels is occupied by the sand stream, as shown in FIGS. 9 and 10, the sand particles tend to stream along the surfaces of the same side of the mixing vanes with the result that substantially none of the particles in each channel are spilled over into the other channel at the leading edges. Moreover, when an excessive flow rate is established, i.e., when over 90% of the volume of the respective channels is occupied by the sand stream, as shown in FIGS. 11 and 12, it has been found that totally unsatisfactory cores or molds result. Not only is the intermingling of the air-sand streams inadequate, resulting in the formation of bands of non-uniformly bonded sand particles in the ultimately-formed mold, but moreover, the integration of the catalyst and resin films is inadequate, resulting in a mold having poor strength and dimensional accuracy.

The actual flow rate required for optimum mixing action depends on the size, form and number of vanes, and on such additional factors as the cross-sectional area and length of the static mixer conduit sections 71 and 81, and the air pressure supplied to the air injection fittings 50, 51 and 60. In practice, it has been found that ratios of sand to air in the conduit of 50% to 90% by volume provide optimum performance.

Another parameter in the static mixer stage which affects the thoroughness of the mixing action is the angular displacement between adjacent ones of the helical vanes 83. In FIGS. 7–12 the helical vanes are shown aligned at approximately right angles, i.e., with the angle $\phi$ between adjacent trailing and leading edges being approximately 90°. However, in FIGS. 13 and 14, the helical vanes 83 have been arranged at an angle $\phi$ of approximately 15°. With this angle it is seen that the sand particles tend to bridge or bunch at the relatively narrow gaps 88 formed between the trailing and leading edges of adjacent vanes with the result that only a small portion of the sand particles are actually divided out and directed to adjacent channels by the leading edges of the vanes. This bridging destroys the thoroughness of the mixing action, and results in the production of cores having weak spots or voids. In practice it has been found that an angle $\phi$ between adjacent vanes of between 20° and 160° is usable, with an angle of approximately 90° being preferred.

Referring to FIG. 15, after the combined air-sand stream had been thoroughly mixed in static mixer stage 68 it may pass through an optional secondary air injection stage 90, wherein an additional stream of pressurized air may be introduced into the air-sand stream by means of an air injection fitting 91. As shown in FIG. 15, air injection fitting 91 is similar to air injection fitting 50, 51 and 60 in that it includes a housing portion 92, a pair of concentric sleeve-like baffles 93 and 94, and an inlet 95 through which pressurized air is admitted. Air admitted through inlet port 95 enters the air-sand stream from mixing section 80 circumferentially and at an angle substantially coincident to the flow path of the stream. This stage is described and claimed in the co-pending application of Joseph N. Kopp et al. Ser. No. 569,828, filed Apr. 21, 1975 and assigned to the present assignee.

After leaving air injection fitting 91, the sand stream passes through a conduit segment 96 which includes a plugable radially extending pressure relief port 97. This port, when not capped by the removable cap 98 shown in FIG. 15, relieves some or all of the downline pressure in conduit segment 96 prior to the sand stream entering the core box. Furthermore, this port provides an escape path for excess catalyzed-resin sand mix, i.e., for sand mix not required in forming the core. Conventional bolt and flange conections may be provided between air injection fitting 91 and conduit segment 96 to enable these stages to be disassembled for cleaning or repair.

As shown in FIG. 15, the secondary air injection stage 90 discharges the catalyzed-resin air-sand stream through a removable reducing fitting 99 into a core box 100. This core box, which may be conventional in design and construction, comprises a two section outer housing 101 into which a conventional vented two section mold 102 is contained. This mold incorporates a cavity 103 shaped to conform to the desired form to the ultimately formed core. The core box housing 101 includes an inlet 104 through which sand is admitted to cavity 103, and a plurality of pressure relief passageways 105 from which air can escape from cavity 103 as the cavity fills with the catalyzed-resin sand mix admitted through inlet 104. Screens 106 of wire mesh or other suitable material may be provided over the ends of passageways 105 as they communicate with the core-forming cavity 103 to allow the pressurized air, but not the catalyzed sand mix, to escape from the cavity during formation of the core. Core box 100 is supported on a support stand 107 at a convenient height under the discharge end of coupling 99. However, it will be appreciated that in high-speed high-volume production operations an automated arrangement would ordinarily be provided to automatically remove filled core boxes and install empty core boxes between each core-forming cycle.

In operation, the slide-type infeed valves 32 and 33 are opened between core-forming cycles as required to allow resin-coated and catalyst-coated sand mixes to enter staging hoppers 22 and 23 from infeed conduits 30 and 31, respectively. The staging hoppers are maintained filled with a sufficient quantity of the respective sand mixes to accommodate one or more core-forming cycles. When the hoppers are not being filled valves 32 and 33 are maintained closed to seal the staging hoppers from conduits 30 and 31.

At the beginning of each core-forming cycle pressurized air is applied through inlet ports 40 and 41 to staging hoppers 22 and 23 to pressurized the hoppers to a predetermined pressure, typically in the order of 8–13 psi. After the hoppers have attained this pressure, the two diaphragm-type outfeed control valves 42 and 43 are opened to allow the catalyst-coated and resin-coated sand mixes from the respective staging hoppers to flow downwardly out of the hoppers and into the primary air injection stage 49. Coincidentally with the opening of outfeed valves 42 and 43, pneumatic pressure is supplied to the air injection fittings 50 and 51, and to the optional air injection fitting 60 if in use, of the primary air injection stage. In air injection fittings 50 and 51 this pressurized air enters the sand flow from hoppers 22 and 23 about the circumference of and at an angle substantially coincident with the flow path of the sand stream. As a result, the sand is directed downwardly in a continuous rapidly moving stream toward the air injection fitting 60. The pressurization of hoppers 22 and 23 serves to prevent the sand mixes from backing up into the staging hoppers and to force sand through valves 50 and 51.

As the resin-coated and catalyst-coated sand streams enter fitting 60, the two streams may be combined under the influence of an optical third air stream injected about the circumference of and substantially coincidentally to the flow path of the combined sand stream. As a result, the combined stream is directed downwardly with great force and speed and in a continuous non-interrupted flow into the buffer section 70 of the static mixer stage 68.

It will be recalled that the purpose of buffer section 70 is to eliminate flow irregularities or surging in the sand stream, and to that end it includes a plurality of wedge-shaped vanes 74 arranged in Y-shaped tiers on a central support member to repeatedly redirect the flow of sand. This has the effect of smoothing out or buffering any flow irregularities, so that the flow of the combined air-sand stream, as it leaves the buffer section 70, is uniform and free of surging.

The mixing section 80, which it will be recalled includes a plurality of helically-shaped vanes 83, receives the buffered air-sand stream and performs a thorough intermingling or intermixing of the resin-coated and catalyst-coated sand particles to produce an integrated mixture of catalyst-coated and resin-coated sand particles from which cores of high uniformity and strength can be formed.

It has been discovered that the mere intermingling of the catalyst-coated sand with the resin-coated sand is not enough, by itself, to produce uniform high strength cured sand shapes. Without being limited to or by any theories of operation, it is believed that it is also necessary to achieve a certain amount of integration of the respective catalyst the resin films on the respective particles prior to deposition of the sand mixture in the mold. In the case of a Furfuryl alcohol-derived resin system, the degree of intermingling and film integration of the sand and resin-coated particles obtained is evidenced not only in the strength and dimensional accuracy, but also in the outward appearance of the core or mold ultimately obtained. For example, a black appearance indicates poor film integration and a weak core, a light green appearance indicates better film integration and a core of moderate strength, and a dark green appearance indicates good film integration and a strong premium core. Any non-uniform appearance of the core, such as the presence of striped or patch-like variations in color or shading, indicates poor intermingling and the presence of areas of weakness.

The optional secondary air injection stage 90 makes possible the production of dark green-colored premium cores on a consistent repeatable basis by circumferentially injecting air under pressure into the combined air-sand stream substantially coincidentally to its flow path to achieve a final intermixing and, it is believed, additional film integration just prior to the time the sand mix enters the core box. It has been found that the timing of this final injection of air is critical, and that to obtain cores of superior uniformity and hardness the air must be injected only while the pulse or mass of sand mix to be deposited in the core box is actually passing through air injection fitting 91, and not prior or subsequent to passage.

Figure 16:
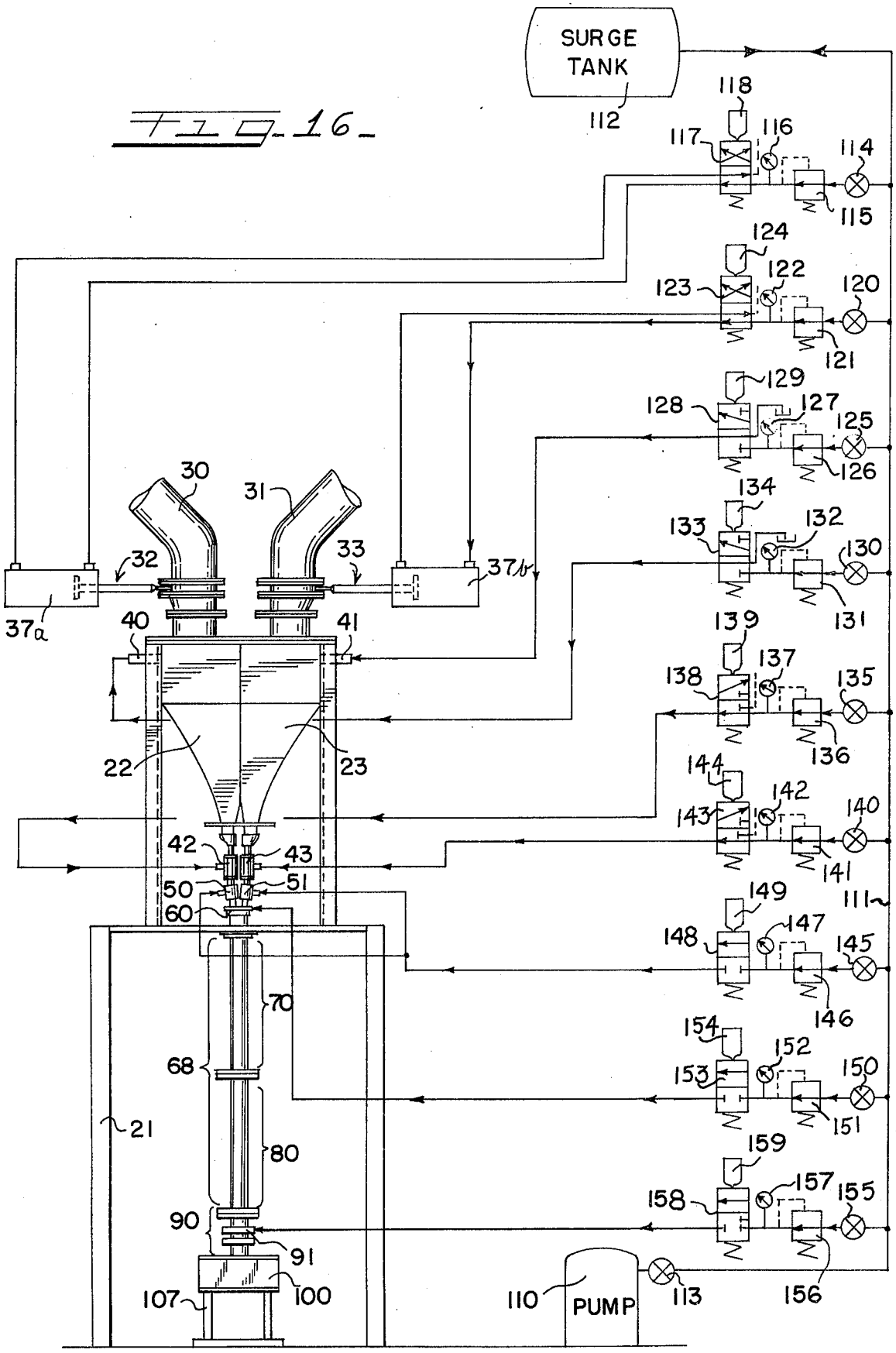
FIG. 16 is a simplified schematic diagram of the pneumatic system utilized in conjunction with the core-making apparatus of FIG. 1.
Figure 17:
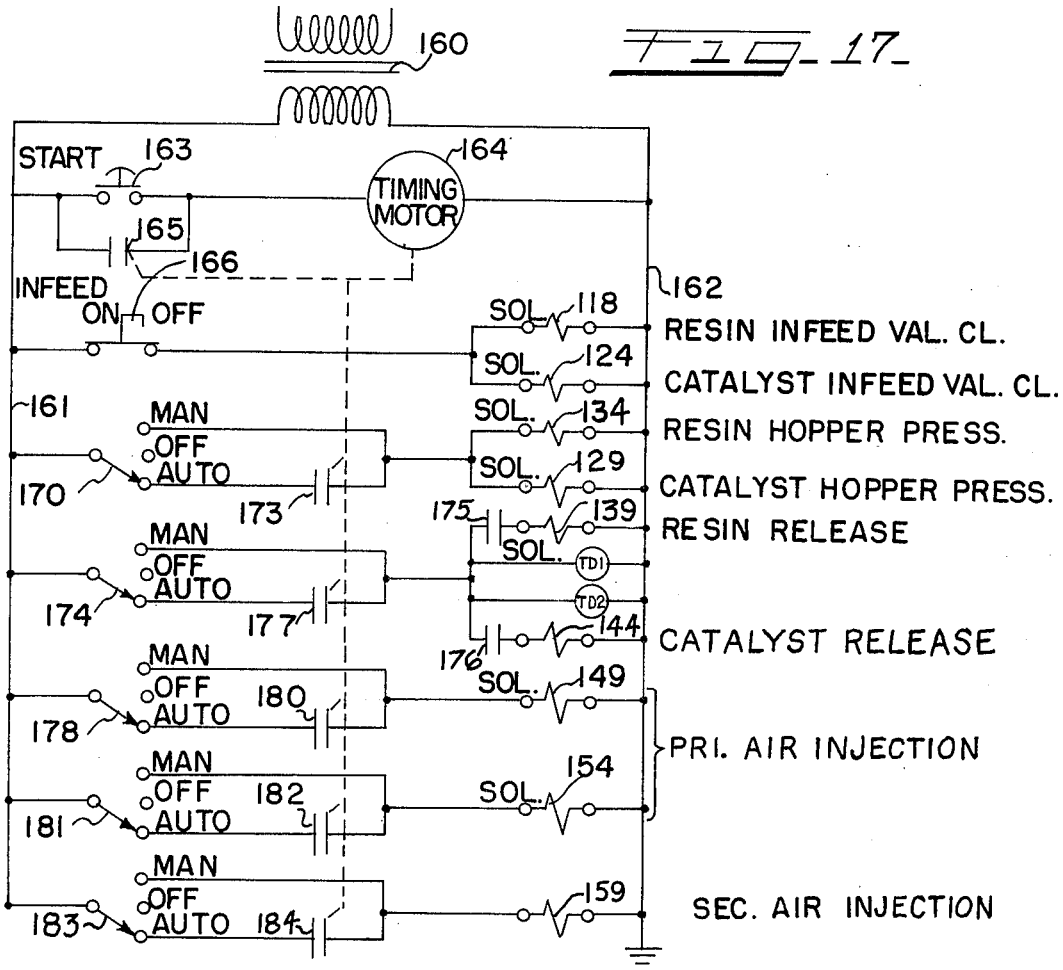
FIG. 17 is a simplified schematic diagram of the electrical system utilized to actuate and control the operation of the core-making apparatus.

The timing of the aforedescribed operations is controlled by the pneumatic and electrical circuits shown in simplified schematic form in FIGS. 16 and 17. Referring to FIG. 16, pressure is supplied to the pneumatic system by means of an air pump 110, which is connected to an air distribution manifold 111 and surge tank 112 through a master air shut-off valve 113. The air in manifold 111, which typically may be pressurized to a pressure in excess of 30 psi, is supplied through a manual shut-off valve 114, a pressure regulator 115, a pressure gauge 116, and a solenoid-operated tow-position four-port control valve 117 to the pneumatic actuator cylinder 37a associated with the blade-type hopper infeed valve 32. A solenoid 118 is provided for actuating control valve 117. Similarly, air from manifold 111 is supplied through a manual shut-off valve 120, a pressure regulator 121, a pressure gauge 122, and a second two-position four-port solenoid-operated control valve 123 to the pneumatic actuator cylinder **37*b* associated with the blade-type hopper infeed valve 33. A solenoid 124 is provided for actuating control valve 123.**

Staging hopper 23 is pressurized from manifold 111 through a pneumatic circuit consisting of a manual shut-off valve 125, a pressure regulator 126, a pressure gauge 127, a two-position two-port solenoid-operated control valve 128, and the inlet port 41 of hopper 23. A solenoid 129 is provided for actuating control valve 128. Similarly, pneumatic pressure is provided to staging hopper 22 by means of a pneumatic circuit consisting of a manual shut-off valve 130, a pressure regulator 131, a pressure gauge 132, a two-position three-port solenoid-operated control valve 133, and the inlet port 40 of hopper 22. A solenoid 134 is provided for actuating control valve 134.

Operation of the diaphragm-type sand mix outfeed valve 42 is obtained from manifold 111 by means of a pneumatic circuit consisting of a manual shut-off valve 135, a pressure regulating valve 136, a pressure gauge 137, and a two-position three-port solenoid-operated control valve 138. A solenoid 139 is provided for actuating control valve 138. Similarly, air is supplied to outfeed valve 43 by means of a pneumatic circuit consisting of a manual shut-off valve 140, a pressure regulating valve 141, a pressure gauge 142, and a two-position three-port solenoid-operated control valve 143. A solenoid 144 is provided for actuating control valve 143.

Pressurized air is supplied to air injection fittings 50 and 51 of the primary air injection stage 49 by means of a pneumatic circuit serially including a manually operated shut-off valve 145, a pressure regulator 146, a pressure gauge 147, and a two-position two-port solenoid-actuated control valve 148. A solenoid 149 is provided to actuate control valve 148. Similarly, air may be provided to air injection fitting 60, if in use, by means of a pneumatic circuit serially including a manually operated shut-off valve 150, a pressure regulator 151, a pressure gauge 152, and a two-position two-port solenoid-actuated control valve 153. A solenoid 154 is provided to actuate control valve 153.

Air is supplied to the air injection fitting 91 of the secondary air injection stage 90 by means of a pneumatic circuit serially comprising a manual shut-off valve 155, a pressure regulator 156, a pressure gauge 157, and a two-position two-port solenoid-actuated control valve 158. A solenoid 159 is provided for actuating control valve 158.

Referring to FIG. 17, power is supplied to the control circuits of core-forming apparatus 20 by means of a step-down transformer 160. One terminal of the secondary winding of this transformer is connected to a supply bus 161 and the other terminal is connected to a ground bus 162.

Figure 18:
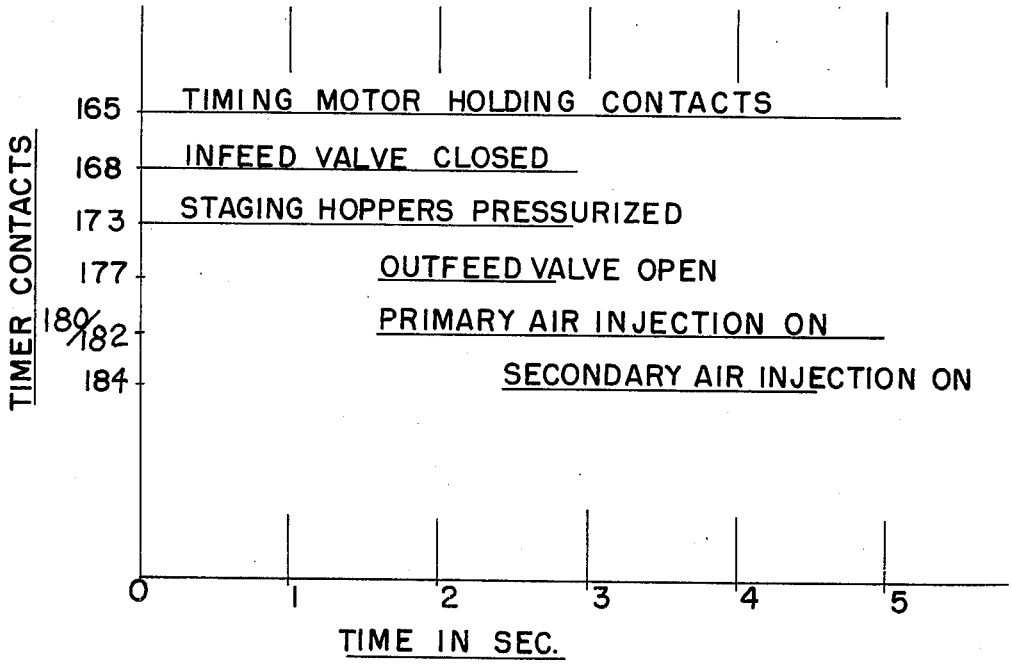
FIG. 18 is a timing chart useful in understanding the operation of the pneumatic and electrical systems of FIGS. 16 and 17, respectively.

Operation of the core-forming machine is initiated by momentary actuation of a START push buttom switch 163, which connects supply bus 161 to a timing motor assembly 164. This assembly includes a timing motor and six sets of normally-open timing contacts which are operated in a desired predetermined sequence for desired predetermined periods of time by means of cams driven by the timing motor. As the timing motor begins to run a first set of normally-open timing contacts 165 connected in parallel with START switch 163 closed to keep the timing motor assembly 164 running after switch 163 has been released. As shown in FIG. 18, these holding contacts remain closed for the duration of the operating cycle.

To control the operation of the sand mix infeed valves 32 and 33 supply bus 161 is connected through a manual switch 166 to solenoids 118 and 124, which control the operation of control valves 117 and 123, and hence the application of pneumatic pressure to actuator cylinders 37a and 37b of valves 32 and 33, respectively. As shown in FIG. 18 or an exemplary five second operating cycle, contacts 168 are closed and the infeed valves are closed for at least the three second period of time in which the infeed hoppers are pressurized.

To control the pressurization of the resin-coated sand mix staging hopper 22 and the catalyst-coated sand mix staging hopper 23, supply bus 161 is connected to a first three-position MANUAL-OFF-AUTO selector switch 170. In the MANUAL position of this switch a circuit is established to solenoids 134 and 129, which control the operation of control valves 133 and 138, and hence the supply of pneumatic pressure to staging hoppers 22 and 23, respectively. In the AUTO position of switch 170 a circuit is established through a second set of normally-open timing contacts 173 of timing motor assembly 164 to solenoids 134 and 129 to bring the pressurization of the staging hoppers under the control of the timing motor assembly. As shown in FIG. 18, for the exemplary five second core-forming cycle contacts 173 are closed and hoppers 22 and 23 are pressurized for the first three seconds of each cycle.

The release of the resin and catalyst-coated sand mixes from staging hoppers 22 and 23 is controlled by connecting supply bus 161 to the arm of a second three-position MANUAL-OFF-AUTO selector switch 174. In the MANUAL position of this switch a circuit is established through a set of normally open contacts 175 of a first time delay relay TD1 to solenoid 143, which controls the application of pneumatic air to the resin-coated sand mix outfeed valve 42, and through a set of normally open contacts 176 of a second time delay relay TD2 to solenoid 144, which controls the application of pneumatic air to the catalyst-coated sand mix outfeed valve 43. The coils of time delay relays TD1 and TD2 are supplied directly by this same circuit. In the AUTO position of switch 174 a similar circuit is established through a third set of normally-open timing contacts 177 of timing motor assembly 164 to solenoids 139 and 144 and time delay relays TD1 and TD2 to place the release of the sand mixes from hoppers 22 and 23 under the control of the timing motor assembly. As shown in FIG. 18, contacts 177 are closed and outfeed of sand from the hoppers takes place between approximately 1.6 to 2.8 seconds in the exemplary cycle.

To control the operation of the primary air injection and flow combining stage 49 supply bus 161 is connected to the art of a third three-position MANUAL-OFF-AUTO selector switch 178. In the MANUAL position of this switch a circuit is established to solenoid 149, which controls the operation of control valve 148, and hence the supply of pneumatic air to air injection fittings 50 and 51. In the AUTO position of switch 178 a similar circuit is established through a fourth set of normally-open timing contacts 180 of timing motor assembly 164 to solenoid 149 to bring the operation of that solenoid under the control of the timing motor assembly. As shown in FIG. 18, contacts 180 are closed to energize the primary air injection stage 49 between approximately 1.6 seconds to 5.0 seconds during the exemplary 5 second core-forming cycle.

When the air injection fitting 60 in primary air injection stage 49 is to be supplied with pressurized air, supply bus 161 is connected to the arm of a fourth three-position MANUAL-OFF-AUTO selector switch 181. In the MANUAL position of this switch a circuit is established to solenoid 154, which controls the operation of control valve 153, and hence the supply of pneumatic air to air injection fitting 60. In the AUTO position of switch 181 a similar circuit is established through a fifth set of normally open timing contacts 182 of timing motor assembly 164 to solenoid 154 to bring the operation of that solenoid under the control of the timing motor assembly. As shown in FIG. 18, contacts 182 are normally closed for the same period of time as contacts 180 to cause simultaneous operation of injection fittings 50, 51 and 60, although in certain applications it is contemplated that is may be desirable to provide a different operating period for injection fitting 60.

To control the operation of the secondary air injection stage 90 supply bus 161 is connected to a fifth three-position MANUAL-OFF-AUTO selector switch 183. In the MANUAL position of this switch a circuit is established to solenoid 159, and hence the supply of pneumatic air to air injection fitting 91 in the secondary air injection stage 90. In the AUTO position of switch 183 a similar circuit is established through a sixth set of normally-open timing contacts 184 of timing motor assembly 164 to solenoid 159 to bring the operation of the secondary air injection stage 90 under the control of the timing motor assembly. As shown in FIG. 18, these contacts are closed and the secondary air injection stage is energized between 2.4 and 4.5 seconds in the exemplary core-forming cycle.

To obtain automatic completion of a core-forming cycle, staging hoppers 32 and 33 are filled by manually actuating INFEED switch 166, all selector switches are positioned to AUTO, and the START push button is depressed. This closed contacts 165 to maintain the timing motor assembly 164 in operation until completion of the core-forming cycle. Timing contacts 173 close for approximately the first three seconds of the operating cycle. This energizes solenoids 134 and 129, causing pneumatic air to be supplied to staging hoppers 22 and 23. Timing contacts 177 of timing motor assembly 164 next close after approximately 1.6 seconds into the cycle, energizing time delay relays TD1 and TD2. After predetermined intervals, the normally-open contacts 175 and 176 of these relays close to energize solenoids 139 and 146, respectively. This releases the resin and catalyst-coated sand mixes from the staging hoppers. As described and claimed in the co-pending application of Joseph F. Kopp Ser. No. 569,825, filed Apr. 21, 1975, and assigned to the present assigned, the use of individual time delay relays in this circuit permits the actual release time of the resin and catalyst-coated sand mixes to be varied, with respect to other functions in the system and with respect to each other to obtain cores of optimum quality and uniformity.

The operation of the primary air injection stage 49 is also initiated at this time by closure of timing contacts 180. This causes solenoid 149 to be energized, opening pneumatic control valve 148 to supply pneumatic air to air injection fittings 50 and 51. The sand mixes released from staging hoppers 22 and 23 now proceed downwardly through the air injection fittings 50 and 51, which inject air under pressure around the circumference and substantially coincidentally to the flow of the sand particles to form two continuous high velocity streams. These streams merge within air injection fitting 60, wherein an additional supply of pneumatic air may be injected by closure of timing contacts 182 to further boost or enhance their stream-like flow.

The combined stream next enters the buffer section 70 of static mixer stage 68 wherein flow irregularities are buffered out to obtain a uniform non-surging flow. The buffered stream of catalyst-coated and resin-coated sand particles then flows into the mixing section 80 of stage 68, wherein helical vane segments 83 accomplish a thorough and complete mixing or intermingling of the resin-coated and catalyst-coated sand particles to obtain a catalyzed-resin sand mix from which the final foundry core is ultimately formed in core box 100. It is at this point, as the pulse of the catalyzed-resin coated sand particles leaves mixing section 80, that the timing motor assembly 164 closed contacts 184 to actuate the secondary air injection stage 90 to supply an additional blast of pneumatic air about the circumference and substantially coincidentally to the flow of sand particles to enhance the integration of the resin and catalyst films on the particles, and hence the strength and uniformity of the ultimately formed core.

As shown in FIG. 18, the operation of the secondary air injection stage 90 continues from a point approximately 2.4 seconds into the cycle to a point approximately 4.6 seconds into the cycle, for the exemplary 5 second core-making cycle. It is also to be noted that timing contacts 177, which control the release of the resin and catalyst mixes, open at approximately 2.8 seconds into the cycle, which time corresponds to the required quantity of sand having left the staging hoppers 22 and 23. To reduce the time required between cycles the staging hoppers can be refilled after contacts 177 open by opening the infeed valves 32 and 33. The application of air from the primary air injection stage 49 continues for the balance of the cycle, i.e., until 5 seconds into the cycle, to assure that all sand particles will be completely purged from the buffer and static mixing stages upon completion of the cycle.

It will be appreciated that the timing cycle shown in FIG. 18 is merely exemplary, and that the duration of the core-forming cycle, as well as the duration and relative timing of the closing and opening of the various timing contacts of timing motor assembly 164, can be adjusted as required by the parameters of the particular mold-forming process. That is, for larger molds, the entire timing cycle can be lengthened, and the starting and stopping of the various functions occurring during the cycle, such as the release of the sand mix and the operation of the primary and secondary air injection stages, can be preset as required by the characteristics of the sand and catalyst sand mixes and the size and shape of the core being produced. Also, by positioning the three-position selector switches to OFF and then selectively to MANUAL, it is possible to manually complete the core-forming cycle. This mode of operation is also useful in cleaning, or during initial set-up and testing of the core-forming apparatus.

While a motor-driven cam assembly has been illustrated for controlling the various stages during operation of the coremaking apparatus, it will be appreciated that other timing means, such as separate electronic timing circuits, could be utilized instead. Furthermore, various interlocking and safety measures, including flow detection means at various points along the buffer and mixing conduit sections, could be provided as a safeguard against possible malfunctioning of the core-forming apparatus.

By way of a specific illustrative example, wherein equal weights of the sand-resin and sand-catalyst ingredients are mixed to form a core or mold, the sand-resin mixture can comprise foundry sand having liquid Furfuryl alcohol resin uniformly coated thereon in an amount sufficient to provide three percent resin by weight based on the weight of the final sand-catalyst-resin mixture. The Furfuryl alcohol may be a formaldehyde copolymer product from a mixture in which the molar ratio of aldahyde to alcohol is 1:2, and the resulting copolymer is diluted with fifty percent monomeric Furfuryl alcohol. The sand-catalyst ingredient has, for example, uniformly coated thereon a 5:2 weight ratio of concentrated phosphoric acid and concentrated sulfuric acid, in an amount sufficient to provide 45 percent catalyst based on the weight of the binder mixtue in the final sand-catalyst-resin mixture.

Very satisfactory results were obtained with this mixture in producing premium cores of good strength and uniformity from 6 to 80 pounds weight using a stainless steel conduit in the static mixing stage having an inside diameter of 3.0 inches. The buffer section 70 of the mixing stage was 12.0 inches long and was provided with 18 vanes arranged in six tiers. The mixing section 80 was 39.0 inches long and was provided with seven helical vanes each 5.5 inches long arranged with a 90° relative bearing. Pneumatic air was supplied to the system at 80 psi and staging hoppers 22 and 23 were pressurized at 10 psi during an initial portion of the cycle, after which the sand mix outfeed valves 42 and 43 were opened from about 1 to 15 seconds, depending on the size of the core, e.g. 1.2 seconds for a seven pound core, and 14.3 seconds for a seventy pound core. After 2–2.5 seconds into the cycle, pneumatic air was applied to the air injection fittings 50 and 51, and optionally to injection fitting 60, and this air injection continued through the balance of the core-forming cycle. After approximately 2.5–3.0 seconds into the cycle the secondary air injection stage 90 was actuated to supply air at a pressure of 10–20 psi for 5–20 seconds, depending on the size of the core, but preferably for a longer time than that used for values 42 and 43.

The core-making apparatus and method of the invention allow the use of a resin-catalyst system having a very fast setting time. As a result, foundry cores or molds are consistently formed having a high degree of dimensional accuracy, good hardness and good uniformity. Furthermore, the rapid setting time of the catalyzed resin sand mix enables the length of the core production cycle to be reduced to a minimum, making the apparatus and method particularly attractive to high-volume production operations where the necessity for having a large number of core boxes and a large storage area brought about by the need for a large residence time in the core boxes would be a substantial economic detriment.

The apparatus and method of the present invention achieve a very rapid and thorough mixing or integration of the resin-coated and catalyst-coated sand mixes by means of a continuous-flow process unique to the foundry core-making field. The two sand mixes are formed into rapidly flowing streams which are merged in one continuous rapidly flowing stream. The combined stream is buffered to eliminate flow irregularities, and then forced through a static mixer wherein the resin and catalyst-coated particles are thoroughly mixed to form a homogenous mix of catalyzed-resin coated particles which is forced into the core-forming mold. By reason of the continuous nature of this process, cores or molds may be readily formed in a wide range of sizes without wasting sand mix, and without the need for making extensive changes in the apparatus. Since the core-forming apparatus requires no mechanically-driven mixing elements, the initial cost and maintenance requirements of the core-forming apparatus are decreased, and the efficiency and reliability of the apparatus are increased.

While a particular embodiment of the invention has been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

We claim:

1. Apparatus for forming from a first mass of particulate matter coated with a catalyst-polymerizable resin film and a second mass of particulate matter coated with a catalyst film for polymerizing said resin, a hardened core or mold, said apparatus comprising, in combination:

means including a first staging hopper for storing a quantity of said first mass of particulate matter;

means including a second staging hopper for storing a quantity of said second mass particulate matter;

a core box having an interior void defining said core or mold;

continuous conduit, means, including a conduit, for establishing a continuous, confined flow path for said particulate masses from said first and second staging hoppers to said core box, said conduit means including a mixing section comprising a static mixer for mixing said masses as they pass through said conduit; and air injection means for establishing a continuous stream-like flow of said particles along said flow path whereby said first and second masses are thoroughly and rapidly intermingled and said films are at least partially integrated to form a catalyzed polymerizable resin-coated particulate mix for deposit directly in said core box.

2. A core or mold forming apparatus as defined in claim 1 wherein said static mixer stage includes a plurality of vanes in said flow path arranged to cause said first and second masses to be thoroughly intermixed.

3. A core or mold forming apparatus as defined in claim 2 wherein said static mixer includes a buffer section in said flow path upline of said vanes for smoothing out flow irregularities in said stream.

4. A core or mold forming apparatus as defined in claim 1 wherein said mixing section comprises a centrifugal separator conduit for maintaining a relatively high density zone of particulate matter at a radially outward portion of said flow path, and a relatively high velocity zone substantially free of said matter at a radially inwardly portion of said flow path.

5. A core or mold forming apparatus as defined in claim 1 wherein said air injection means inject air circumferentially and substantially coincidentally to said flow path with sufficient velocity to maintain substantially all of said particulate matter is suspension in said stream-like flow in said conduit.

6. A core or mold forming apparatus as defined in claim 1 wherein said conduit is straight and vertical.

7. A core or mold forming apparatus as defined in claim 1 wherein said static mixer means include a flow buffer section in said flow path upline of said mixing section for smoothing out irregularities in said particle stream.

8. A core or mold forming apparatus as defined in claim 1 wherein flow control means including a pair of valves are disposed between said hoppers and said static mixer means for controlling the flow of said particulate masses into said core box.

9. A core or mold forming apparatus as defined in claim 1 wherein said staging hoppers are pressurized.

10. A core or mold forming apparatus as defined in claim 1 wherein flow control valve means are provided between said staging hoppers and said conduit for allowing only the quantities of said resin-coated and catalyst-coated particulate masses required for forming said core or mold to enter sand conduit.

11. Apparatus for forming from a first mass of particulate matter coated with a catalyst-polymerizable resin film for polymerizing said resin, a hardened foundry core or mold, said apparatus comprising, in combination:

means including a first staging hopper for storing a quantity of said first mass of particulate matter;

means including a second staging hopper for storing a quantity of said second mass of particulate matter;

a core box having an interior void defining said core or mold;

continuous conduit means, including a conduit, for establishing a continuous, confined flow path for said particulate masses to said core box, said conduit including a mixer section having a plurality of vanes in said flow path, and said conduit also including a buffer section having a plurality of flow dividing vanes in said flow path upline of said mixer section for smoothing out flow irregularities; and air injection means between said staging hoppers and said static mixer means for injecting air into said flow path to establish a stream-like flow of said particles and establish at least a partial integration of said resin and catalyst films.

12. A method of blending respective ingredient sands having respective liquid films dispersed on the surface thereof, and of substantially mixing and integrating the respective films, one of said films being a catalyst-hardenable binder, the other of said films comprising a catalyst for hardening said binder, said method comprising: simultaneously introducing said sand ingredients into a moving carrier air stream thereby forming an air-sand stream, channelling the air-sand stream through static mixer means for intermingling said ingredient sands for substantially integrating the films therein, thence by means of said air-sand stream transporting and depositing the resulting mixture directly into a shaping cavity, and hardening the resulting mixture in said shaping element, said air-sand stream being continuously confined between said introducing and said depositing.

13. The method defined in claim 12 wherein said path is in a generally vertical direction.

14. The method defined in claim 12 wherein the air-sand stream is maintained at a velocity which is sufficiently high to maintain substantially all of the sand is suspension in the air-sand stream along the entire length of said path.

15. The method of preparing a shaped mass of blended sands having liquid film dispersed on the surface thereof from at least two ingredient sands having respective films of liquid coated thereon, and of substantially integrating and mixing said films, one of said films being a catalyst-hardenable binder, the other film comprising a catalyst for hardening said binder, said method comprising simultaneously introducing the sand ingredients into a moving carrier air stream thereby forming a moving air-sand stream, channelling the resulting air-sand stream at relatively high velocity through a centrifugal separator conduit whereby a relatively high sand density zone of said air-sand stream is maintained at the radially outward portion of the separator conduit, and a relatively high velocity sand-free zone of said air-sand stream is maintained radially inwardly of the high sand density zone, and moving the air-sand stream in the separator conduit for a distance sufficient to substantially integrate said films, channelling and discharging the resultant air-sand stream mixture directly into a shaping element, and hardening the resulting mixture in said shaping element, said air-sand stream being continuously confined between said introducing and said discharging.

16. The method of forming a foundry core or mold from a first mass of particulate matter coated with a catalyst-polymerizable resin film and a second mass of particulate matter coated with a catalyst film for polymerizing said resin, comprising the steps of:

simultaneously introducing said masses or particulate matter into a moving carrier air stream to form a high-velocity stream wherein substantially all of said particulate matter is suspended;

channelling said high velocity stream through a static mixer stage to intermingle said particulate masses and substantially integrate said films thereon; and depositing by means of said high velocity stream, the resulting catalyzed-resin coated mixture in a shaping cavity, said high velocity stream being continuously confined between said introducing and said depositing, and hardening said resulting mixture in said shaping cavity.

17. The method defined in claim 16 wherein quantities of said particulate mass sufficient only to form said core or mold are introduced into said carrier air stream.

18. The method defined in claim 16 wherein air is injected into said stream circumferentially at an angle substantially coincident to the flow path of said particulate matter.

* * * * *